US006275675B1

(12) United States Patent
Cornelius

(10) Patent No.: US 6,275,675 B1
(45) Date of Patent: Aug. 14, 2001

(54) ELECTRONICALLY CONDUCTING SEGMENTED HOPPER CONSTRUCTION FOR TONER CARTRIDGE

(76) Inventor: Lester E. Cornelius, c/o Optical Technologies Corp. 47-00 33rd St., Lic, NY (US) 11101

( * ) Notice: Subject to any disclaimer, the term of this patent is extended or adjusted under 35 U.S.C. 154(b) by 0 days.

(21) Appl. No.: 09/520,037

(22) Filed: Mar. 7, 2000

Related U.S. Application Data

(60) Provisional application No. 60/153,702, filed on Sep. 14, 1999.

(51) Int. Cl.[7] ..... G03G 15/08
(52) U.S. Cl. ..... 399/262; 399/260
(58) Field of Search ..... 399/262, 263, 399/252, 260; 222/DIG. 1

(56) References Cited

U.S. PATENT DOCUMENTS 3,910,459 * 10/1975 Bock et al. ..... 222/DIG. 1 X
4,350,432 * 9/1982 Kondoh ..... 399/274

FOREIGN PATENT DOCUMENTS 54-89741 * 7/1979 (JP) .
54-91329 * 7/1979 (JP) .
4-52671 * 2/1992 (JP) .
6-72472 * 3/1994 (JP) .

* cited by examiner

*Primary Examiner*—Quana M. Grainger
(74) *Attorney, Agent, or Firm*—Charles E. Temko

(57) ABSTRACT

A replacement toner hopper for use with replaceable toner cartridges used in electrostatic copying and printing machines. The hopper provides increased capacity using converging hopper walls more horizontally oriented than those of the original hopper. The tendency of the particulate toner to adhere to the inner surfaces of the hopper walls is reduced by charging at least one of the hopper walls with a semi-conductive or conductive surface to electrostatically discharge the toner, charge normally carried by the toner.

5 Claims, 1 Drawing Sheet

ELECTRONICALLY CONDUCTING SEGMENTED HOPPER CONSTRUCTION FOR TONER CARTRIDGE

This application claims the benefits of U.S. Provisional Application No. 60/153,702, filed Aug. 14 1999.

BACKGROUND OF THE INVENTION

This invention relates generally to the field of toner cartridges used in the dispensing of toner in particulate form used by electrostatic copiers, and more particularly, to an improved construction providing superior hopper capacity and feeding of toner particles to a dispensing opening.

In recent years, the performance of electrostatic copiers has been substantially improved from the aspect of copy and print quality. It has been found that when the image is formed of toner particles of smaller size, in the order of four microns, the resultant images are sharper, and there is less tendency to form image defects, such as ghosting, grain of white backgrounds, and the like. The most commonly used toners typically have a particle size averaging eight microns. With improved techniques, particle sizes are capable of reduction to particle size as little as five microns. With smaller particle size, the amount of toner used, a portion of which is wasted, is considerably reduced, as a result of which an individual toner cartridge may offer a substantially extended life cycle before replacement is necessary.

Unfortunately, the above-described smaller particle toner is not, at the present state of the art, capable of being manufactured at a cost comparable to that of the larger size particle toners. As a result, much of the replacement or re-manufactured toner cartridges are refilled with particulate toner of relatively larger sized particles, typically, eight microns.

It is possible, however, to extend the life cycle of such toner cartridges by increasing the toner capacity of the hopper contained within the toner cartridge. The size of the replacement hopper must, of course, conform to the available space within the toner cartridge and, as a result, in many cases, the hopper includes converging walls which are disposed at an angle considerably less steep with respect to the direction of toner flow when compared with the hopper which it replaces. Such configurations tend not to promote the flow of toner to the hopper discharge opening. In addition, most toners carry a static charge which tends to cause agglomeration, and also, a tendency to be attracted to the inner surface of the toner hopper. Where the walls of the toner hopper are considerably less steep, or more horizontal, the tendency of a substantial amount of toner to remain in the hopper at a distance from the point of discharge is substantially increased.

SUMMARY OF THE INVENTION

Briefly stated, the disclosed invention contemplates the provision of an improved replacement toner hopper particularly adapted to permit the use of increased toner capacity, which substantially increases the useful life cycle of the replacement toner cartridge.

To this end, the replacement toner cartridge is configured for increased capacity, and includes means for preventing or substantially reducing the amount of toner which does not feed freely to the point of discharge from the hopper.

This is accomplished by forming the replacement hopper of synthetic resinous material which is capable of being electrostatically discharged, and thus, flow freely under the action of gravity to the area of discharge. In many cases, it will not be convenient to mold the hopper in a single piece, because of the necessity of assembling the hopper inside the toner cartridge. In such cases, not all of the pieces which form the walls of the hopper need be electrostatically discharged.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
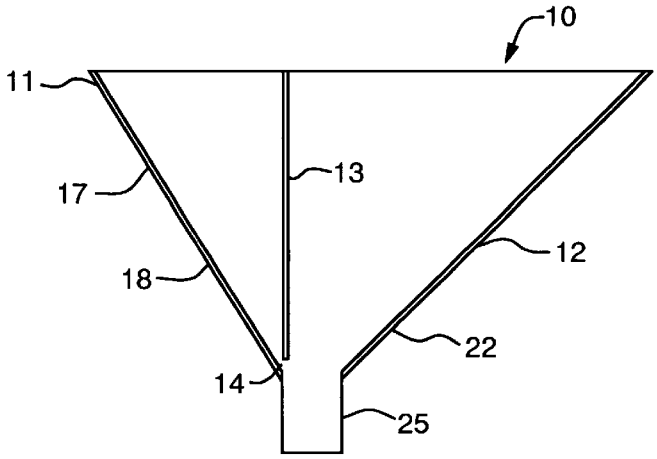
FIG. 1 is a side elevational view of an embodiment of the invention.
Figure 2:
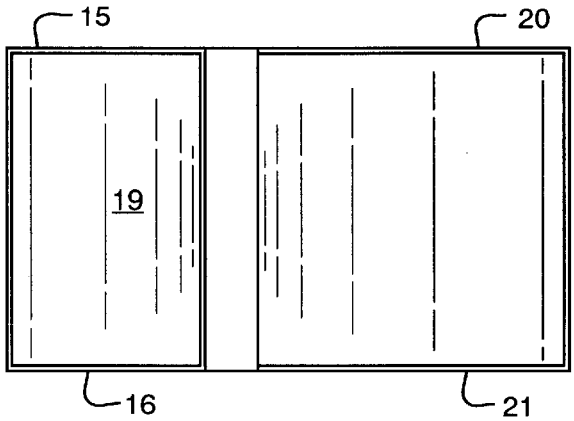
FIG. 2 is a top plan view thereof.
Figure 3:
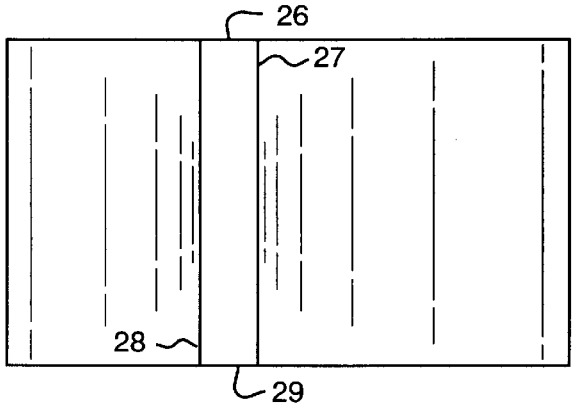
FIG. 3 is a bottom plan view thereof.

In accordance with the invention, the device, generally indicated by reference character 10, includes first and second toner wall elements 11 and 12 which are interconnected at a continuous interfitting edge 13. Most suitably, both of the elements are formed from a synthetic resinous material, such as polyethylene, polyvinyl acetate, polycarbonates, and the like. Where the material is inherently electrically conductive, it may be used directly. In the case of materials which are not electrically conductive, conductivity is obtained by mixing substantial quantities of carbon black or the like, in the molding material.

The first hopper wall element 11 includes first and second vertically-oriented planar side walls 15 and 16, as well as an angularly-oriented side wall 17, each wall including an outer surface 18 and an inner surface 19. The second hopper wall element 20 also includes first and second vertically-oriented walls 20 and 21 as well as an angularly-oriented side wall 22, each wall being bounded by an outer surface 23 and an inner surface 24. The second element 12 may also include an integrally molded spout 25 bounded by side walls 26, 27, 28, and 29 leading to an area of discharge.

In some cases, it will be possible to assemble the elements of the hopper prior to insertion into the toner cartridge. In other cases, because of the presence of other operative elements comprising the toner cartridge, and because of the increased size of the hopper compared to the hopper which it replaces, it may be necessary to insert the individual wall elements into the cartridge, and assemble the same in situ. In those instances where the elements of the hopper may be slidably engaged, the continuous edge 13 may include a dovetail interfitting means at those portions of each edge which are slidably engaged, and supplemented by a tongue and groove at the lower portion 14. In particular situations, such inter-engagement is not possible, in which case, the interfitting portions may be provided with a suitable glue or synthetic resinous adhesive which may be thermally cured, or by the use of ultraviolet irradiation.

It will be also understood by those skilled in the art that the toner hopper may require more than two wall elements to accommodate for space occupied by other operative elements within the toner cartridge. In most cases, it will be possible to have at least some of the side walls in substantially vertical orientation. The angularly-oriented side walls will be positioned to provide a greater degree of taper than obtained with the original hopper, with a corresponding greater tendency of the particulate toner contained by the hopper to adhere to the inner surface of these walls during toner discharge. The tendency for the toner to be electrostatically attracted to the inner surface of such angularly-oriented walls is overcome by the electrostatic on charging of the wall elements with a semi conductive or conductive surface.

The inside surface of the hopper may be coated with a suitable material that meets the same requirements. The three requirements are reduced triboelectrc charging of the toner from contact with the hopper surface, a smooth low friction surface, and a semi-conductive to conductive surface to discharge any unwanted electrostatic charging of the toner while it is in the hopper.

One of the additional benefits is that removing the triboelectric charging of the toner to free its movement in the hopper, is that it allows the developer assembly to control the charge more reliably. This is especially true in low humidity environments, where the toner is already significantly charged by agitation in the hopper prior to its movement through the developer assembly.

Coatings that are suitable for the inside surface of the hopper include plating with conductive metals, such as aluminum, nickel, chromium or brass. Nickel and chromium are preferable because of lower oxidation potential. Aluminum will form aluminum oxide, and thus prevent the small toner particles from reaching the conductive aluminum underneath the non-conductive aluminum oxide. This is equally true of brass.

Other polymeric coatings can be used, including acrylics, urethanes, or silanes which have been modified to be semi-conductive or conductive with the addition of powdered metals or conductive materials such as carbon black. The choice of binder materials and the level of conductivity is dependent on the triboelectric nature of the toner to be used in the hopper, and the subsequent steps in the electrophotographic process of the development design.

A typical polymeric coating formulation is an acrylic with carbon black added to create a surface resistivity of less than $10^{12}$ ohms/squared. Levels below $10^{8}$ ohms/squared are considered to be conductive. The surface resistivity level will control the static dissipation speed of the toner.

Thus, there has been provided a toner hopper construction of substantially increased capacity relative to that of original equipment manufacturer, enabling the useful life cycle of a re-manufactured cartridge to be substantially extended, and comparable in many cases to that obtained with toner cartridges using particulate toner, the particles of which are substantially smaller than that of older type toners. In most cases, when re-manufacturing the toner cartridge, the original hopper can be removed without difficulty, and the replacement hopper may be either, as readily installed, or in some cases, it may be necessary to form the replacement hopper in several parts to permit assembly in situ prior to refilling the toner. In some cases, only one wall element will include a wall which requires electrostatic discharging, and the manufacture of the elements may be such that only that particular molding need be electrostatically dischargeable.

I wish it to be understood that I do not consider the invention to be limited to the precise details of structure shown and set forth in the specification, for obvious modifications will occur to those skilled in the art to which the invention pertains:

What is claimed is:

1. An improved hopper for use with a toner cartridge forming part of an electrostatic copier, said hopper comprising: a plurality of separable synthetic resinous wall members selectively interconnected in leak-proof relation, said wall members converging to an area of discharge, at least one of said walls being electrostatically conductive and capable of dissipating a static electric charge on an inner surface thereof.

2. The hopper set forth in claim 1, in which at least one of said wall members lies in a substantially horizontal plane.

3. The hopper in accordance with claim 1, including means for electrostatically discharging said at least one wall member.

4. In combination, a toner hopper forming part of an electrostatic copier, said hopper comprising a plurality of synthetic resinous wall members selectively interconnected in leak-proof relation, said walls converging to an area of discharge, at least one of said walls being electrostatically conductive and capable of discharging a static electric charge on at least an inner surface thereof; and a quantity of particulate toner having an electro-static charge of opposite plurality, said wall having an electrostatic charge, whereby a portion of said toner in contact with an inner surface of said wall is electrostatically discharged to facilitate flow of said toner.

5. A hopper in accordance with claim 1 in which said at least one wall is coated on said inner surface with an electrostatically conductive material.

* * * * *